US006605423B2

(12) United States Patent
Guilment et al.

(10) Patent No.: US 6,605,423 B2
(45) Date of Patent: Aug. 12, 2003

(54) METHOD FOR PREPARING A SILVER HALIDE PHOTOGRAPHIC EMULSION

(75) Inventors: Jean Guilment, Saint-Rémy (FR); Olivier J. Poncelet, Chalon sur Saône (FR)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/107,988

(22) Filed: Mar. 27, 2002

(65) Prior Publication Data

US 2003/0008250 A1 Jan. 9, 2003

(30) Foreign Application Priority Data

Mar. 28, 2001 (FR) ..... 01 04126

(51) Int. Cl.[7] ..... G03C 1/025
(52) U.S. Cl. ..... 430/569
(58) Field of Search ..... 430/569

(56) References Cited

U.S. PATENT DOCUMENTS 5,451,324 A 9/1995 Gehin et al. ..... 210/668
5,681,692 A 10/1997 Orem et al. ..... 430/569

FOREIGN PATENT DOCUMENTS

| | | |
|---|---|---|
| EP | 930 532 A1 | 7/1999 |
| FR | 2 688 777 | 9/1993 |
| JP | 11-147381 | 6/1999 |

*Primary Examiner*—Hoa Van Le
(74) *Attorney, Agent, or Firm*—Andrew J. Anderson

(57) ABSTRACT

The present invention relates to a method for preparing a silver halide photographic emulsion, comprising the steps of a) providing a nucleation medium comprising an aqueous composition based on a hydrophilic colloid and a non-ionic antifoaming agent;

b) precipitating silver halide nuclei in said nucleation medium;

c) growing said silver halide nuclei to form a silver halide photographic emulsion; and d) removing the non-ionic antifoaming agent from the nucleation medium by contacting the silver halide photographic emulsion resulting from step c) with a material that has surface lipophilic functions.

8 Claims, No Drawings

METHOD FOR PREPARING A SILVER HALIDE PHOTOGRAPHIC EMULSION

FIELD OF THE INVENTION

The present invention relates to a method for preparing a silver halide emulsion.

BACKGROUND AND PROBLEM TO BE SOLVED

An essential component of a photographic film is a silver halide emulsion, comprised of a dispersion of silver halide crystals dispersed in a protective colloid. To prepare this light-sensitive dispersion, the first step is to precipitate the silver halide crystals by the reaction of an aqueous solution of a silver salt (silver nitrate in most cases) with an aqueous solution of an alkali metal halide (chloride, bromide or iodide of an alkali metal). This reaction is generally carried out with an excess of halide in the presence of a hydrophilic colloid (generally gelatine or a derivatives thereof) to obtain a stable dispersion without agglomeration of the crystals so formed.

To favor this dispersion, a vigorous mechanical stirring is generally used, the effect of which is to generate foams. To avoid the generation of foam, which is troublesome when emulsions are prepared in industrial quantities, antifoaming agents are commonly used. It is now recognized that some of these antifoaming agents can interact with gelatine and lead to undesirable reactions such as the agglomeration of silver halide grains. U.S. Pat. No. 5,681,692 mentions this agglomeration effect. It is also known that certain antifoaming agents, when they are present in a photographic silver halide emulsion, can affect the sensitometric characteristics of this emulsion. In other cases, they can also affect the physical uniformity of the emulsion and so generate physical defects when the silver halide emulsion is coated on the support.

Because of the need to eliminate foaming during the precipitation of silver halide emulsions, it is not possible to avoid the use of antifoaming agents. However, after the silver halide grain precipitation stage, it would be desirable to rid the emulsion of these agents, but without creating additional complex steps in the photographic emulsion manufacturing process.

SUMMARY OF THE INVENTION

One object of the present invention is to provide a method for preparing a silver halide photographic emulsion that overcomes the problem stated above.

The present invention relates to a method for preparing a silver halide photographic emulsion that comprises the steps of:

a) providing a nucleation medium comprising an aqueous composition based on a hydrophilic colloid and a non-ionic antifoaming agent;

b) precipitating silver halide nuclei in said nucleation medium;

c) growing said silver halide nuclei to form a silver halide photographic emulsion; and d) removing the non-ionic antifoaming agent from the nucleation medium by contacting the silver halide photographic emulsion resulting from step c) with a material that has surface lipophilic functions.

DESCRIPTION OF PREFERRED EMBODIMENTS

The nucleation medium comprises a peptizing agent that is typically a hydrophilic colloid such as gelatine, modified gelatine, for example phthalylated gelatine, or oxidized gelatine, i.e., gelatine containing less than 30 micromoles of methionine per gram. The hydrophilic colloids that can be used in the invention are described in Research Disclosure, September 1996, n° 38957, Chapter II-A pages 598–599.

Non-ionic antifoaming agents include poly (dimethylsiloxane) derivatives, for example those cited in U.S. Pat. No. 5,837,439, polyethylene glycol dioleate (Emerest 2648®, manufactured by Henkel), polyethylene glycol ditallate (4-5 EO MAPEG 200 DT®, manufactured by PPG Specialty Chemicals), polyethylene glycol dilaurate (4-5 EO MAPEG DL®, manufactured by PPG Specialty Chemicals), SILWET L-720® (manufactured by OSI Specialties), SILWET L-722® (manufactured by OSI Specialties), together with those cited in Research Disclosure, January 1995, n° 36929, page 29.

Conventionally, the term "nucleation" designates the step between the beginning of the introduction of the reagents and the end of the introduction of the reagents, in which the nuclei of silver halide are precipitated. During this step, a significant part of the silver consumed thus serves to precipitate further grains, rather than to grow the grains already formed. Various conventional methods can be used to carry out the nucleation of silver halide grains. In single jet processes, an aqueous solution of silver salt is introduced in a stirred reactor containing a colloid, generally gelatine or one of its above-mentioned equivalents, and an aqueous solution of halides. In double jet processes, the solutions of silver and halide salts are introduced simultaneously or alternately from separate sources in a stirred reactor containing the colloid. The formation of nuclei can be carried out by simultaneous or alternate double jets or successive simple jets of silver nitrate followed by halide. In either case the growth step immediately follows, and is typically carried out by a double-jet precipitation. Growth may also be performed by the addition and ripening-out of preformed fine silver halide grains. A third type of process exists comprising first a nucleation step carried out in a first reactor by simultaneously introducing solutions of silver and, halide salts and colloid, and a growth step in a second reactor by introducing a solution of silver salt and one or more halide solutions.

The nucleation step is carried out in the presence of a mechanical stirring that in certain mixers can reach rotation rates of the order of 10,000 r.p.m. Examples of stirrers are described in Research Disclosure n° 38213, February 1996, pages 111–114 and Research Disclosure n° 38957, September 1996, Chapter I, Part C-3, page 595.

In accordance with the invention, the material that bears lipophilic functions on its surface is able to dissolve the non-ionic antifoaming agent, thereby removing it from the nucleation medium. It is theorized that the antifoaming agent is trapped by the material owing to the presence of lipophilic functions on its surface and despite the presence of a peptizing agent in the nucleation medium.

After use, the material bearing lipophilic functions on its surface can be washed with a solvent that dissolves the antifoaming agent, thereby allowing the antifoaming agent to be recovered and the material to be re-used.

In a specific embodiment of the invention, the material comprises an inert support on which lipophilic functions have been grafted by means of covalent Si—O— bonds. In this case, a support is selected that possesses active groups on its surface that will participate in the grafting of lipophilic functions thereby forming a lipophilic layer on that surface. Active groups can be created on the surface of a support by chemical treatment of the support, for example by treating the support with a base or an acid. The support can also be treated with a silicon or aluminum halide. These active groups can be acid or hydroxyl groups, preferably hydroxyl groups. To graft lipophilic functions onto this support, the support bearing the active groups on its surface is placed in contact with a compound able to both react with the active groups and supply lipophilic functions. The active groups on the support will react with this compound and so permit the grafting of lipophilic functions that will form a lipophilic layer on the surface of the support.

In one embodiment of the invention, the grafting of the layer onto the support is achieved by the "self-assembly" method, i.e., using the ability that certain chemical compounds have to self-assemble when they react on a surface. This method was described by Abraham Ulman in "Formation and Structure of self-assembled Monolayers" Chem. Rev. 1996, 96, 1553–1554.

According to the invention, the support can be organic and (or) inorganic. The organic supports that can be used are polyethylene, poly ethylene terephthalate, polyvinyl chloride, cellulosic materials, etc. The inorganic supports that can be used are for example clays, hydrotalcite, pumice, imogolite, phyllosilicates, vermiculite, glass, metals, etc. These supports can take various forms, for example films, particles, porous materials, plane surfaces, etc. In one embodiment of the invention the compound able to provide the lipophilic functions is selected among the following:

alkylphosphonic acids, alkylphosphinic acids, alkylphosphinous acids, mono- or diesters of phosphoric acid, -alkylalkoxysilanes of formula $R_nSi(OR)_{4-n}$, alkylhalosilanes of formula $R_nSiX_{4-n}$, alkylacetoxysilanes of formula $R_nSi(COCH_3)_{4-n}$, where R is an alkyl group with at least three atoms of carbon, X=halogen atom (for example C1), and n is 1, 2 or 3, or a mixture of these compounds.

In one embodiment, the compound able to provide lipophilic functions contains at least one alkyl radical with at least three carbon atoms. In a specific embodiment, the compound able to provide lipophilic functions is an alkylacetoxysilane in which at least one of the alkyl groups contains at least three atoms of carbon. The alkylalkoxysilanes that can be used in the scope of the invention are for example trimethoxypropylsilane, triethoxypropylsilane, triethoxyoctylsilane, and diethoxydipropylsilane. The alkylacetoxysilanes that can be used are for example octyltriacetoxysilane, dioctyldiacetoxysilane, pentyltriacetoxysilane, butyltriacetoxysilane, pentyltriacetoxysilane, hexyltriacetoxysilane, heptyltriacetoxysilane, octadecyltriacetoxysilane, etc. The alkylhalosilanes that can be used are for example propyltrichlorosilane, dipropyldichlorosilane, dibutyldichlorosilane, propylbutyldichlorosilane, methylbutyldichlorosilane, butyltrichlorosilane, pentyltrichlorosilane, dipentyldichlorosilane, hexyltrichlorosilane, octyltrichlorosilane, nonyldichlorosilane, dodecyltrichlorosilane, etc. The alkylphosphonic acids are for example methylphosphonic acid, octylphosphonic acid, dodecylphosphonic acid, etc. The alkylphosphinic acids are for example dipropylphosphinic acid, dioctylphosphinic acid, butylpropylphosphinic acid, etc. The alkylphosphinous acids are for example butylphosphinous acid, octylphosphinous acid, decylphosphinous acid, etc.

When silanes such as those described previously are used, the lipophilic functions can be obtained from a solution of silane in an aprotic anhydrous solvent. This solution is placed in contact with the "active" support in the presence of water. By hydrolysis of the silane, a Si—O bond is formed between the support and the silane radical, which is thus grafted on the support. A homogeneous layer is formed owing to the —Si—O—Si— bonds between the silane radicals. In this way, a material is obtained with a lipophilic surface that is mechanically and chemically highly resistant. It was discovered, surprisingly, that the material with the lipophilic surface according to the invention traps the non-ionic antifoaming agent present in the nucleation medium containing the hydrophilic colloid.

In addition to the above-mentioned steps of the method according to the invention, the preparation of the emulsions can include conventional operations such as a washing step, for example using the ultrafiltration method described in U.S. Pat. No. 5,248,418, or other common washing methods such as those described in Research Disclosure, September 1996, Chapter III, page 601. The emulsions can be sensitized chemically and spectrally as stated in Research Disclosure, op.cit. Chapters IV and V. The emulsions can contain conventional additives such as anti-UV compounds, optical brighteners, antifogging agents, stabilizers, light-absorbing or reflecting agents, or an agent mentioned in Research Disclosure op.cit. Chapters VI, VII and VIII. The emulsions can also contain agents that modify the physical properties of the layers, or that facilitate the formation of layers such as those described in Research Disclosure op.cit. Chapter IX.

The method of the present invention can be carried out in a device consisting of a reactor in which an emulsion of silver halide is precipitated, a part of the reactor being composed of a material that bears surface lipophilic functions. In one embodiment the material forms at least one inner wall of the reactor. In another embodiment the material is reversibly fixed on at least one of the inner walls of the container. The material can take various forms, for example films, particles, porous materials, plane surfaces, etc. When it takes the form of particles, the material can be held in containers of the "tea-bag" type or in cartridges.

EXAMPLES

Example 1

Preparation of Octyltriacetoxysilane

In a 1-1 round-bottomed flask were placed first 55 g of anhydrous sodium acetate, and then 500 ml of anhydrous heptane. To the white suspension formed was added 50 g of octyltrichlorosilane. The reaction medium was left under stirring at ambient temperature for 2 h, and then filtered under argon to remove the precipitate. The filtrate was concentrated to eliminate the heptane, giving 54 g (88% yield) of octyltriacetoxysilane as a colorless oil.

Example 2

Preparation of a Polyethylene Terephthalate Support Coated with a Monolayer of Polyalkylacetoxysiloxane A homogeneous solution was prepared by mixing 3 ml of octyltriacetoxysilane in 120 ml of dry tetrahydrofuran. Into this mixture was immersed a plane polyethylene terephthalate support. The support was removed from the solution, which was hydrolyzed by the action of moisture in the air. In this way a lipophilic layer was formed by hydrolysis. The material thereby obtained was washed with osmosed water until washings of pH 7 were obtained. The material obtained comprised a polyethylene terephthalate support coated with a polyalkylacetoxysiloxane monolayer.

Example 3

Invention

In a reactor was introduced with stirring a solution containing 10 g of gelatine (treated with lime), 0.63 g of the antifoaming agent Emerest 2648® (polyethylene glycol dioleate, manufactured by Henkel), 30 g of sodium bromide and 4,946 g of distilled water. The temperature of the mixture was brought to 45° C. The precipitation was effected by simultaneous addition 2.75 moles of silver nitrate (solution A) and 2.87 moles of sodium bromide, at a flow rate of 35 ml/minute for 1.3 minutes. The temperature of the mixture was maintained at 48° C. during the precipitation. After one minute was added 379 ml of a solution (0.475 M) of ammonium sulfate. After a further 2 minutes was added 200 ml of a solution (1.9 M) of sodium hydroxide. After a further 30 seconds was added 200 ml of a solution (1.9 M) of nitric acid. A solution containing 140 g of gelatine and 1,729 g of distilled water was added to the reaction medium, which was then left to stand for 5 minutes. The growth step was then carried out by addition of solution A as indicated in Table 1, with the pBr maintained at 1.57 by simultaneous addition of a solution of sodium bromide.

TABLE 1

| Duration | Flow rate of solution A, ml/minute | |
|---|---|---|
| minutes | Start | End |
| 5 | 15 | 15 |
| 25 | 15 | 40 |
| 31 | 40 | 102 |
| 1.5 | 100 | 100 |

At the end of the growth step were successively added to the reaction medium:
71.5 ml of a solution (2.65 M) of sodium bromide
0.45 mole of fine grains of silver iodide, and
solution A at a flow rate of 50 ml/min for 24 minutes, and when the pBr reached 2.62, a solution of sodium bromide via a twin jet in order to maintain the pBr at that value.

At this point was dipped into the reaction medium a support made of polyethylene terephthalate prepared by the operating procedure described in Example 2 taking the form of strips 16 mm wide with a total surface area of 0.025 $m^2$. The emulsion was then washed and concentrated by ultrafiltration. A{111} tabular grain silver bromoiodide emulsion containing 3.6% mol of iodide was obtained, having the following characteristics:

Equivalent circular diameter (ECD): 0.94 microns.

Thickness: 0.09 microns.

Measurement of a sample of this emulsion by AFM showed that the grains having the above characteristics accounted for at least 70% of the entire grain population.

Measurement of the size and thickness of the grains was performed by atomic force microscopy (AFM).

Measurement by high performance liquid chromatography (HPLC) showed that no free antifoaming agent was left in the medium.

Example 4

The wetting angle of the polyethylene terephthalate support grafted according to the procedure described in Example 2 was measured in the following liquids: water, gelatine (type 31 supplied by Rousselot), and antifoaming agent Emerest 2648 (polyethylene glycol dioleate).

The wetting angles were obtained by the Wilhemy method based on the measurement of the force required to remove from a liquid a thin strip of the material suspended from one arm of a balance and dipping into the liquid. The liquid was maintained at 24° C. Beforehand, the surface tension of the liquid □ was measured using a strip of filter paper for which θ=0. The wetting angle θ (or contact angle) is defined by the following formula:

$$\cos\theta = \Delta W / Pe.Y$$

where ΔW is the variation in weight of the strip when it comes in contact with the liquid, and Pe is the perimeter of the strip.

The results are given in Table 2.

TABLE 2

| | | θ (degrees) Average of 5 measurements |
|---|---|---|
| Exp. 1 | Non-grafted support/water | 55.88 |
| Exp. 2 | Grafted support/water | 110.43 |
| Exp. 3 | Non-grafted support/gelatine | 42.94 |
| Exp. 4 | Grafted support/gelatine | 111.10 |
| Exp. 5 | Grafted support/ antifoaming agent | 77.26 |

The contact angle θ characterizes the ability of the drop to wet the surface. Wetting is good if θ is less than 90°, and is perfect if θ is nil, whereas wetting is poor if θ is greater than 90° and would be nil if θ was 180°.

It is noteworthy that the grafting of lipophilic functions on the support, according to the operating procedure described in Example 2, improved the affinity of the support for the antifoaming agent, while at the same time lowering its affinity for water and gelatine.

What is claimed is:

1. A method for preparing a silver halide photographic emulsion comprising the steps of:

a) providing a nucleation medium comprising an aqueous composition based on a hydrophilic colloid and a non-ionic antifoaming agent;

b) precipitating silver halide nuclei in said nucleation medium;

c) growing said silver halide nuclei to form a silver halide photographic emulsion; and d) removing the non-ionic antifoaming agent from the nucleation medium by contacting the silver halide photographic emulsion resulting from step c) with a material that has surface lipophilic functions.

2. The process of claim 1 wherein the material employed in step d) comprises an inert support on which lipophilic functions are grafted by means of covalent Si—O— bonds.

3. The process of claim 1 wherein the material employed in step d) is obtained by the reaction product of an inert support bearing hydroxy functions with a compound selected from the groups consisting of:

alkylphosphonic acids, alkylphosphinic acids, alkylphosphinous acids, mono- or diesters of phosphoric acid, alkylalkoxysilanes of formula $R_nSi(OR)_{4-n}$, alkylhalosilanes of formula $R_nSiX_{4-n}$, and alkylacetoxysilanes of formula $R_nSi(COCH_3)_{4-n}$, where R=alkyl group with at least three atoms of carbon, X=halogen atom, and n=1 to 3.

4. The process of claim 3 wherein the support is a polyester support.

5. The process of claim 4 wherein the support is a polyethylene terephthalate support.

6. The process of claim 3 wherein the support is porous.

7. The process of claim 1 wherein the non-ionic antifoaming agent is a polyethyleneglycol dioleate.

8. The process of claim 1 wherein the hydrophilic colloid is gelatine or a gelatin derivative.

* * * * *